United States Patent [19]

Neves

[11] Patent Number: 4,593,584

[45] Date of Patent: Jun. 10, 1986

[54] POWER TONGS WITH IMPROVED HYDRAULIC DRIVE

[75] Inventor: Billy W. Neves, Odessa, Tex.

[73] Assignee: Eckel Manufacturing Co., Inc., Odessa, Tex.

[21] Appl. No.: 624,146

[22] Filed: Jun. 25, 1984

[51] Int. Cl.[4] ..... B25B 17/00

[52] U.S. Cl. ..... 81/57.18

[58] Field of Search ..... 81/57.11, 57.15, 57.18

[56] References Cited

U.S. PATENT DOCUMENTS 4,215,602 8/1980 Carstensen et al. ..... 81/57.18

4,357,843 11/1982 Peck et al. ..... 81/57.18 X

FOREIGN PATENT DOCUMENTS 964161 3/1975 Canada ..... 81/57.15

*Primary Examiner*—James G. Smith

*Attorney, Agent, or Firm*—Carwell & Helmreich

[57] ABSTRACT

Power tongs are described for making up and breaking apart joints of pipe. The hydraulic system of the tong comprises a tandem fluid motor which enables both forward and reverse operation of the tong in one of several selected speed/torque ranges by operating a pair of control handles. The open throat tong includes a door latching mechanism for automatically locking and unlocking the tong door when activating the tong hydraulic system. The tong dies come into gripping engagement with the pipe over a large composite arcuate angle to increase the pipe gripping ability of the tong.

18 Claims, 5 Drawing Figures

POWER TONGS WITH IMPROVED HYDRAULIC DRIVE

BACKGROUND OF THE INVENTION

The present invention relates to power tongs commonly used in drilling operations for threadably connecting and disconnecting tubular members. More particularly, the present invention relates to the hydraulic system for operating such a power tong in one of several speed/torque ranges, and to an open throat power tong with improved means for locking and unlocking the open throat tong door.

Power tongs may generally be classified as open throat or closed throat tongs. Closed throat tongs are described in U.S. Pat. Nos. 3,371,562, 3,483,774, 3,550,485, and 3,589,742. Since the rigid tong encompasses the pipe, the closed throat tong resists spreading and is generally capable of achieving high make up and break out torques. The disadvantage of a closed throat tongs, however, is that the tong body cannot be laterally put on or taken off a pipe. Open throat tongs, as shown in U.S. Pat. Nos. 3,021,739, 3,180,186, 3,196,717, and 4,084,453 enable the tong to move laterally with respect to the joint of pipe, and generally include a door latching mechanism for connecting the tong body in the open throat area. A variation of a closed throat tong is shown in U.S. Pat. No. 4,334,444, wherein both the tong body and the rotatable cam ring have pivotable portions for opening to laterally position the tong on the pipe, and both pivotable portions can be locked to approximate closed throat tong rigidity.

It is generally desirable that a power tong be operable at different speed/torque ranges and in both forward (make up) and reverse (break out) directions. Various systems have been devised for enabling a power tong to be operable at high speed/low torque while routinely threading together the joints of pipe, and low speed/-high torque while making up the final desired pipe threading-torque. U.S. Pat. No. 4,346,629 discloses a commonly used technique for manually shifting gearing of a tong to achieve either low speed or high speed output U.S. Pat. No. 3,635,105 discloses a tong with first and second motors for operating the ring gear, with a clutch driven part either idling along with the first motor or being driven by the second motor. U.S. Pat. No. 4,333,365 discloses a hydraulic system for operating a drive motor at different speed/torque ranges depending upon the activation of a pressure-intensifying or boosting means for selectively increasing the hydraulic fluid pressure to the motor. Finally, Canadian Patent No. 1,088,918 discloses a power tong employing a two-speed hydraulic motor.

The systems described in the above patents may allow both forward and reverse operation of a tong at different speed/torque ranges, but tong operators generally disfavor systems which require operation of a large number of controls. Thus, an operationally simplistic two speed tong may be preferred by an operator over a tong having a complicated drive system allowing for tong operation of various speeds by controlling numerous levers and gauges. Also, drive systems which utilize a mechanical gear shifting apparatus generally require slowdown of the tong prior to shifting, which increases the time required to make up pipe joints. Finally, many of the drive systems described in the above patents are mechanically and/or hydraulically complicated and expensive, and the advantages of a sophisticated tong hydraulic system generally cannot offset the disadvantages encountered if that tong experiences frequent breakdown in the field.

Most open throat tongs employ a door which preferably is both closed and latched (or locked in) before operating the tongs at high torque. Tongs may employ a door actuation mechanism to hydraulically close the tong door, as shown in U.S. Pat. No. 4,084,453. The problems encountered when a tong door is operated at high torque and the door is not properly latched are described in U.S. Pat. No. 4,170,907, which patent also describes a door interlock system for preventing a tong from operating if the door is not fully shut and secure. U.S. Pat. No. 4,334,444 also discloses a door interlock system, and further illustrates a hydraulic cylinder and latch for insuring complete closure of the door.

Tong operators nevertheless frequently do not utilize the door locking mechanism provided on a tong, because the locking of a tong door is another operation in a series of operations which must be rapidly and efficiently performed to make-up or break apart pipe. Also, it is common knowledge among tong operators that an open throat tong will not experience excessive spreading under low torque required in many operations. The door is thus often not closed for low torque operations provided the operators are cautious of the safety hazards associated with operating the tong when the door is open. Certain tongs may be provided a powered door closer, but powered door closing devices may also be a safety hazard to the operator standing in the area adjacent the door. If door interlock systems as described above are employed, operators may bypass the systems to allow more efficient tong operation. Also, the more sophisticated the system in the power tong, the higher the risk that the tong may breakdown in the field, and the more likely that the operator will develop techniques to avoid or bypass the system.

A further disadvantage of prior art tongs is that such tongs generally grip the pipe for rotation over a relatively limited contact area. As shown in U.S. Pat. No. 4,334,444, for instance, many tongs employ two pivotably movable or sliding heads with two elongate dies for each head. U.S. Pat. No. 4,346,629 discloses the usage of somewhat larger area dies in the heads, although these dies may not effectively grip the pipe for rotation without crushing or damaging the pipe.

The disadvantages of the prior art are overcome by the present invention, and improved methods and apparatus are described herein for making up and breaking apart joints of pipe.

SUMMARY OF THE INVENTION

A power tong is provided employing improved hydraulic circuitry for operating a three-speed tandem fluid motor to achieve forward and reverse hydraulic operation in any of three selected speed/torque ranges. A valve block employing two 4 way/3 position valves is utilized, so that one of three selected tong speeds and either forward or reverse tong operation may be controlled by operating only two valve handles associated with the valve block.

The open throat tong includes drive means for automatically locking closed the pivotable tong door to prevent spreading of the tong. A hydraulic tong latch motor adjacent the tong latch is powered for automatically locking the door when the tong is operated, and automatically unlocking the door when the tong is not being operated. The door may be either manually or automatically opened and closed, but when closed may be automatically locked by the hydraulic latch motor.

The open throat tong according to the present invention may also include a plurality of pivotably movable or slidable heads with an increased composite angle of die engagement with the pipe. Two dies preferably grip the pipe over a composite angle of at least 230° to minimize the likelihood of galling or crushing the pipe.

It is therefore a feature of the invention to provide a tong with a reliable drive means capable of operating in one of at least three selected speeds/torque ranges.

It is a further feature of the present invention to provide a power tong with improved drive means which may be easily and quickly shifted from one speed to another speed by operating a minimum number of controls.

It is still another feature of the present invention to provide an open throat tong with a door latching mechanism for automatically locking the door when the tong is operated.

It is a further feature of the present invention to provide a tong with dies on a plurality of die carriers for effectively gripping the pipe over a large composite angle without crushing or damaging the pipe.

These and other features and advantages of the present invention will become apparent from the following detailed description, wherein reference is made to the Figures in the accompanying drawings.

DETAILED DESCRIPTION OF THE DRAWINGS

Figure 1:
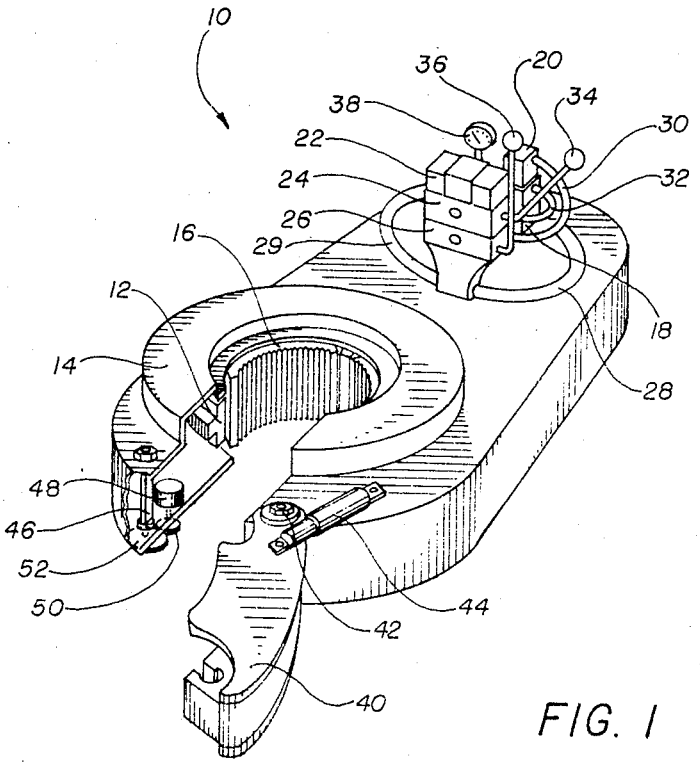
FIG. 1 is a simplified pictorial view of an open throat power tong according to the present invention.

FIG. 1 depicts a power tong 10 for making up and breaking apart threaded tubular members, such as drill pipe, casing, or tubing. The tong 10 is of the open throat type, with a ring member 12 and a cage plate assembly 14 both including open throat portions so that the tong may be laterally moved on and off a string of pipe. The basic operation drive gearing of the tong are described in U.S. Pat. No. 4,084,453, which is hereby incorporated by reference. For the present, it should be understood that the drive means of the tong acts to rotate the ring 12 relative to the cage plate 14, causing a pair of dies 16 to come into gripping engagement with the pipe, and that thereafter the partial ring 12 and cage plate 14 may be driven in unison to rotate or thread an upper pipe relative to a lower pipe.

The drive means according to the present invention comprises a vane-type tandem hydraulic fluid motor. Although manufactured as a single unit, the tandem motor structurally and functionally may be understood as both a medium speed hydraulic motor 18 and a high speed hydraulic motor 20 mechanically connected by a common drive shaft so that both motors locate in unison. Motors 18 and 20 may be powered by a skid-mounted hydraulic unit (not depicted) which supplies pressurized hydraulic fluid to the tong through conduit 28. Fluid is returned via line 29 to a tank (not shown) associated with the hydraulic unit.

Hydraulic fluid may be directed to the motors through valve block 22, which includes valve assembly 24 for controlling fluid flow to the medium speed motor 18, and valve assembly 26 hydraulically in parallel with valve assembly 24 for controlling fluid flow to the high speed motor 20. Valve assembly 24 may be actuated by horizontal control handle 34, and valve assembly 26 may be actuated by vertical control handle 36. Representative flexible flowlines 30 and 32 from the valves to their respective motors are shown, as well as a representative gauge 38 for monitoring the fluid pressure to either or both of the motors.

The open throat tong 10 is shown with door 40 in the partially open position. Door 40 is pivotally connected to the rigid body of the tong at 42, and when properly locked, the door acts to prevent "spreading" of the tong in the area of the open throat under high make up or break out torques. Many tong operators prefer that the door be manually opened and closed, since the operator is generally in the vicinity of the tong door when being placed on or taken off a pipe, and since a powered door closure may be a safety hazard. Also, allowing for manual closure of the door allows an operator to operate the tong at low torque when the door is open, and thus the operator need only close the door when high torque is required. If a power door closure is desired, however, hydraulic cylinder 44 may be provided between the tong body and the door. Suitable cylinder-type door closure devices are more fully described in U.S. Pat. Nos. 4,084,453 and 4,334,444, which are hereby incorporated by reference.

The automatic door lock device of the present invention comprises pin 46 rotatably mounted to the tong body in a position for latching the door in the closed position. Pin 46 may be connected to an adjacent hydraulic motor 48 by gears 50 and 52, so that motor 48 acts to latch or lock the door in the closed position and unlatch the door so that the door subsequently may be opened to move the tong laterally on or off the pipe. The output torque from motor 48 achieves a mechanical advantage through gears 50 and 52, since gear 52 has approximately twice the diameter of gear 50.

Figure 2:
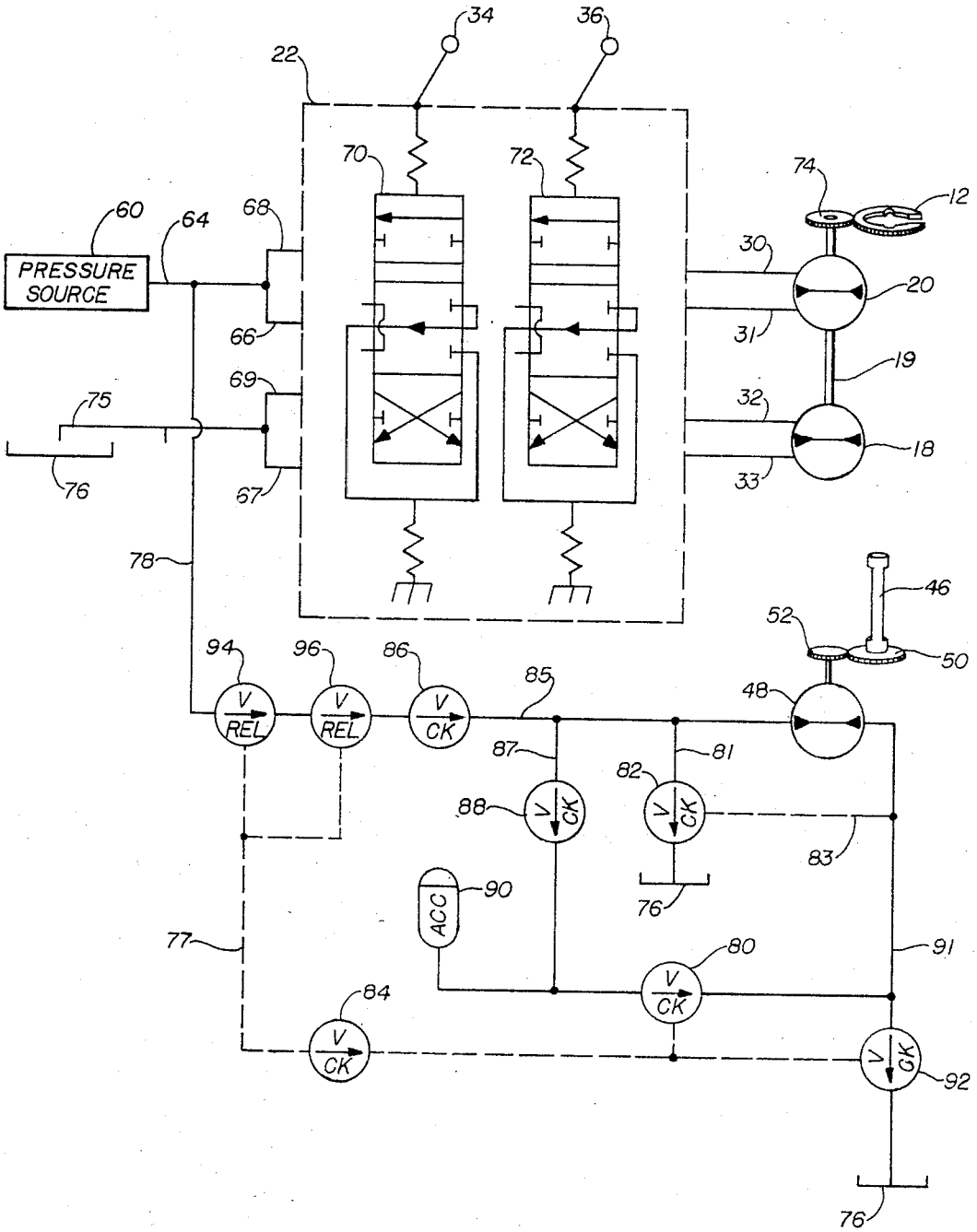
FIG. 2 is a schematic diagram of a hydraulic arrangement according to the present invention.

Referring to FIG. 2, a simplified hydraulic circuit is shown according to the present invention, with components similiar to those previously mentioned hereinafter noted by the same reference number. A hydraulic unit or pressurized source 60 may provide hydraulic fluid to the tong through line 64, and the maximum hydraulic fluid pressure in line 64 would normally be within the range of from 1800 psi to 3000 psi. Restrictions in the valve block 22 keep a back-pressure, e.g. 280 psi, in line 64 even when the valve block is in a "free wheeling" or center condition. Valve block 22 may be a single unit with a single input line and a single output line to the valve block, but functionally is composed of valve spools 70 and 72 in parallel, with flowline 66 providing fluid pressure to valve spool 70, and flowline 68 similarly providing fluid pressure to valve spool 72. Drain lines 67 and 69 from the valve block feed to common drain line 75 which flows to tank 76.

Each valve spool 70 and 72 is manually controlled by its respective handle 34 and 36, and is preferably spring centered so that the operating ports of the valve are held in a center position by the spring until moved by the operator. The valve shown in FIG. 1 are 4 way, 3 position type valves. When one of the valve spools 70 and 72 are moved by the operator into either the forward or reverse drive positions (with forward preferably being away from the operator and reverse being toward the operator), all the fluid is directed to one work port and on to its respective motor, while the other work port is open to return flow to the tank. In the center (float, neutral, or free wheeling) position, the work port of each valve is open, and hydraulic fluid flows directly to the tank 76 bypassing the motors 18 and 20.

Thus, the valve block 22 and the operator handles 34 and 36 may be used to independently start, reverse, or "free wheel" each of the fluid motors 18 and 20. Fluid lines 30, 31, 32, and 33 connect the valve block to each motor. Fluid lines 30 and 32 act to supply fluid pressure to the motors 20 and 18, respectively, when the motors are operated in the forward position, and lines 31 and 33 serve as return lines back to the valve block. When the motors are reversed, lines 31 and 33 act as supply lines while lines 30 and 32 serve as return lines.

As previously indicated, the high speed motor 20 and the medium speed motor 18 are mechanically connected in tandem so that both motors rotate simultaneously. The motors may thus be provided with a common drive shaft 19 which rotates the cartridges of both motors simultaneously. Suitable tong gearing is shown in U.S. Pat. No. 4,084,453, and is shown representatively in FIG. 2 as gear 74 which directly drives the ring member 12. Suitable vane-type tandem fluid motors are manufactured by Abex/Denison and are described in their service literature bulletin SFM-M4DC(Rev.A), which bulletin is hereby incorporated by reference. For the tong shown in FIG. 1, C cartridge code 043 for the high speed motor 20 and D cartridge code 102 for the medium speed motor 18 may be used. Suitable valve blocks 22 according to the present invention are manufactured by Commercial Sheering, Inc. and are described in the brochure entitled "A20/A35 Directional Control Valves" hereby incorporated by reference into the present case. The apparatus as shown in FIG. 1, a suitable valve block is sold under the designation A20CA12-8MA53MA53Z16.

Figure 3:
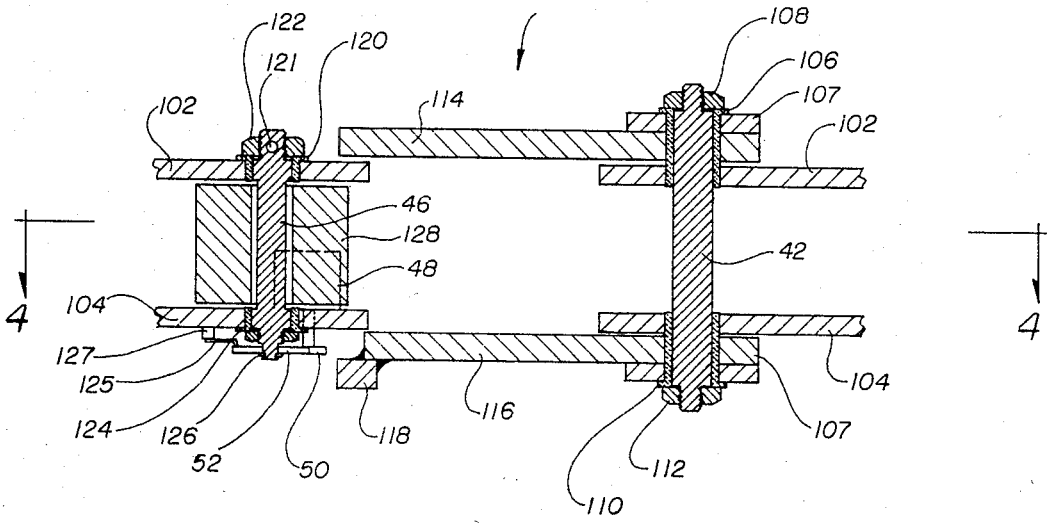
FIG. 3 is a side view, partially in cross-section, of a pivotable tong door and latch mechanism according to the present invention.

FIG. 3 depicts a side view, partially in cross-section, of a door 40 and a suitable valve latch mechanism according to the present invention. The door 40 comprises upper and lower door plates 114 and 116 spaced respectively above and below tong body plates 102 and 104. The door pivots about pin 42 rotatably mounted to the tong body plates. Upper bushing 106 is secured by nut 108 threaded to the pin 42, and lower bushing 110 is similarly secured by nut 112. Suitable spacers 107 may be provided between the nuts and the plates 114 and 116.

FIG. 3 illustrates that block 128 mounted to the door may be spaced between tong plates 102 and 104 and aligned for receiving pin 46. Pin 46 is rotatably mounted to the tong body at the opposite side of the tong throat from pin 42. Bushing 120 is provided between the upper tong plate 102 and the pin 46. Nut 122 may be threaded to pin 46 and is secured for rotation with the pin 46 by a removable rivet 121, so that pin 46 may be manually rotated by a wrench applied to nut 122. Relatively thin bushing 124 is provided between the lower tong plate 104 and pin gear 52, which is keyed to the pin and secured by a snap ring 126. Hydraulic motor 48 is mounted between the tong plates and adjacent the pin 46, and includes a shaft extending downward through the lower tong plate 104 with gear 50 affixed thereto. Hydraulic motor 48 thus rotates gear 50, which meshes with gear 52 to obtain rotation of the shaft 46.

Figure 4:
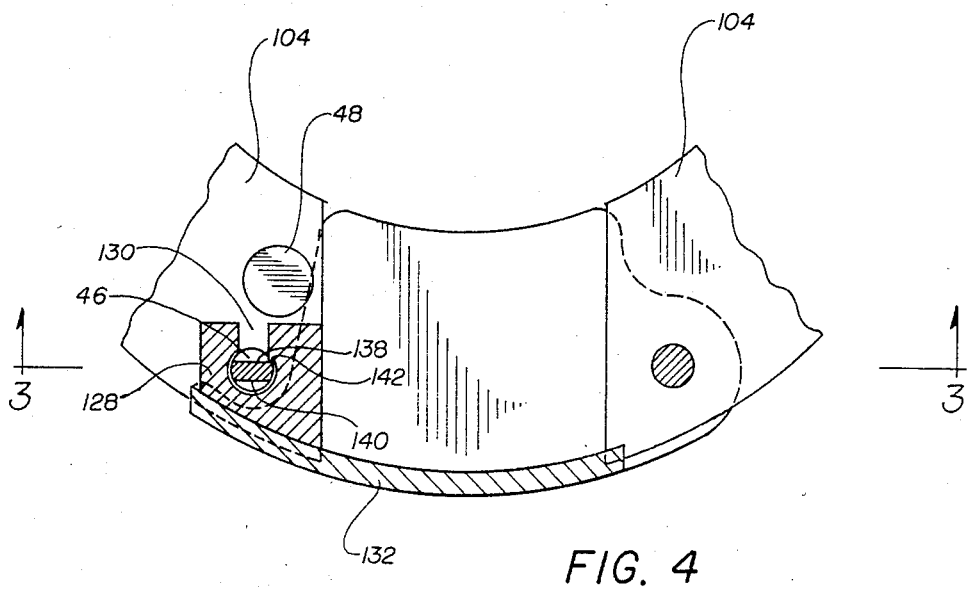
FIG. 4 is a cross-sectional view of the apparatus depicted in FIG. 3.

FIG. 4 depicts a cross-sectional view of the tong door and latch mechanism shown in FIG. 3. The top plate 114 and the composite bottom plates 116, 118 may have the same general configuration as the bottom plates 116, 118 shown in FIG. 4. Alternatively, since the bottom plate 118 may be provided below the gears 50 and 52, and the bottom plate 118 could extend outwardly to serve as a guard under the gears 50 and 52.

The relationship of the closed door to the open throat of the tong and the bottom tong plate 104 is also shown in FIG. 4. The door includes a curved vertical plate 132 spaced between horizontal plates 114 and 116, with block 128 welded to the plate 132. Pin 46 includes recessed surfaces 138 and 140, and it should be understood that the pin would be rotated 90° from that position depicted in FIG. 3 so that the slot portion 130 of block 128 may receive the pin. Thereafter, the pin may be rotated to the position as shown in FIG. 4, so that the curved outer surfaces of the pin engage the inner surfaces of the slot 130. When the pin is in the position shown in FIG. 4, the door is latched or locked in place. The distance between pin 42 and pin 46 is thus fixed by the rigid door, so that substantial "spreading" of the open throat of the tong cannot occur. Although not necessary, the slot 130 of the door may include stop 142, which is discussed subsequently.

Referring particularly to FIGS. 1 and 2, the operation of the tong will now be described. By moving one or both of the handles 34 and 36 from their center position, fluid will flow to one or both motors 18 and 20, thus rotating the tandem motor in one of three selected speeds/torque ranges and in either the forward or reverse directions. The tandem motor drives a gear train (representatively shown as gear 74), which drives partial ring 12. Each valve assembly 70 and 72 is spring biased in the neutral position, so that fluid to the valves will be dumped back to the return if both valves are in the center position. Thus, the operator need only control one or both of the handles 34 and 36 to achieve the desired speed and directional rotation for the partial ring 12.

Referring particularly to FIGS. 2 and 4, the operation of the door latch mechanism of the invention will now be described. The door 40 normally should be closed prior to operating the tong, and may be moved in the closed position since pin 46 would normally be rotated for receiving the slot 130 in block 128. Prior to closure, the handles 34 and 36 would normally be in their center free wheeling position, since the gear 12 is not rotating. At this time, some nominal back pressure, e.g., 280 psi, may be in line 78. Relief valve 94, which may be set at 300 psi, would be closed so that no fluid pressure was applied to motor 48.

Once either or both of the handles 34 or 36 are removed from their center positions so that fluid pressure is applied to the tandem motor, pressure in line 78 will increase to over 300 psi, causing valve 94 to open and further releasing pilot fluid pressure in line 77 to close normally open check valve 80 and open normally closed check valve 92. (Check valve 84 simply functions to prevent pilot fluid from subsequently flowing back to relief valve 94.) Pressure in line 78 would rise rapidly causing relief valve 96, set for example at 300 psi, to open, releasing fluid pressure in line 85 and past check valve 86. Since check valve 80 is still closed, fluid pressure via line 87 increases the pressure in accumulator 90 while fluid pressure is applied to motor 48 to rotate pin 46. Check valve 92 continues to be opened by the pilot pressure, so that fluid may dump to tank 76 via line 91.

Fluid pressure may thus be applied to motor 48 to rotate pin 46 to lock the door 40 closed. Only 350 psi to motor 48 may be required to rotate pin 46 to lock the door closed, although motor 48 may be subjected to the same level of fluid pressure that is applied to the tandem motors, which could be as high as 2000 or 3000 psi. After the pin 46 is rotated 90°, further rotation would be prevented by stop 127 (or stop 142), and motor 48 would stall out, increasing fluid pressure in accumulator 90 to the approximate line pressure applied to the tandem motors.

When both handles 34 and 36 are returned to their center position, the door 40 is automatically unlocked as follows. Fluid pressure in line 78 falls below the setting of relief valve 94, so that check valve 80 again opens and check valve 92 closes. Fluid pressure in accumulator 90 is prevented from returning to line 85 via check valve 88, and is also prevented from returning to tank 76 since check valve 92 is no longer held open. Approximately 2000 to 3000 psi may thus be applied to motor 48 from accumulator 90 to return the pin to its position as shown in FIG. 3. Check valve 82, which is normally closed, is held open by fluid pressure from pilot line 83, so that fluid from motor 48 is dumped back to tank 76 through line 81.

After rotating the pin 90°, the motor 48 may be stalled by engagement of gear finger 125 secured to gear 52 with stop 127. Alternatively, the door could be provided with stop 142, so that the pin 46 would engage the stop 142 after rotating 90° to stall out the motor 48. Motor 48 need only be a low horsepower hydraulic motor capable of generating several foot pounds of torque. A suitable motor 48 is sold by Barnes Pumps under Model 1300098, referenced on page 83B of Catalog 365-U, entitled "Fluid Power Designer's Manual" by Womack Machine Company. Alternatively, a pivotable hydraulic cylinder, a pneumatic motor, or other drive means could be used to rotate the latch pin. It is a feature of the invention, however, that a drive means and hydraulic circuit be provided in the tong for automatically locking the closed door to prevent tong spreading, by merely operating the controls necessary to obtain the desired rotation of ring 12.

Thus, the door 40 is automatically locked and unlocked without requiring action by the tong operator aside from normally operating the hydraulic handles 34 and 36. If the door were not closed prior to operating the tong, the same hydraulic sequence of events would occur so that pin 46 would be rotated, although the block 128 would not be in a position to lock the door closed.

Figure 5:
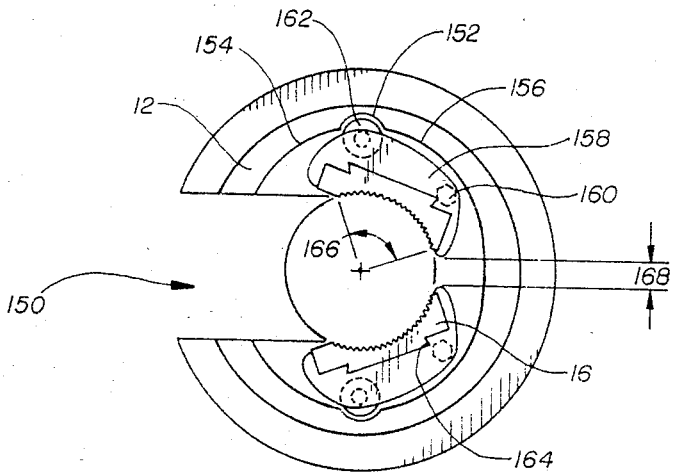
FIG. 5 is a top view of a portion of the apparatus depicted in FIG. 1 showing dies in engagement with a pipe.

FIG. 5 depicts a simplified top view of a portion of the tong shown in FIG. 1 with the upper cage plate removed for clarity. According to the present invention, the tong may be provided with either pivotable heads 158 which rotate about pivot pin 160, or with sliding heads as depicted in U.S. Pat. No. 3,390,323. Partial ring 12 includes neutral cam surfaces 152, forward cam surfaces 154, and reverse cam surfaces 156. Suitable camming surfaces are more particularly described in U.S. Pat. No. 4,084,453. For the present, it should be understood that a roller 162 is connected with each head and engages the camming surfaces when the ring 12 rotates relative to the cage plate, causing the dies 16 to come into gripping engagement with the pipe.

The dies which engage the pipe preferably function to grip the pipe under high torque without crushing or damaging the pipe. Poor gripping engagement of the dies with the pipe may cause the dies to excessively score and damage the pipe, since the dies may rotate relative to a poorly gripped pipe. On the other hand, excessive biting force transferred to the pipe by the dies may crush or collapse the pipe, especially if the force is applied in concentrated locations or a substantial non-radial force is applied to the pipe.

According to the present invention, the open throat tong is provided with a plurality of dies 16 which come into arcuate gripping engagement with the pipe over a composite angle greater than that provided in the prior art to more uniformly grip the pipe. The depth of each of the dies 16 will generally be determined by the spacing between the cage plates, and generally is in the range of 2½ to 6 inches. Each of the dies 16 preferably engages the pipe through an angle 166 of at least 115° and preferably at least 120°, so that a composite gripped angle between 240° and 250° is possible. If a 245° composite gripped angle is obtained from the dies, the spacing 168 between the back of the dies will generally be quite short, e.g., ¾" or less. As shown in FIG. 5, each of the dies 16 includes dovetail portion 164, so that each die may be easily secured into its respective head.

When operating the tong as shown in FIG. 1, the selected speed/torque ranges for the tong will generally depend on the maximum diameter of the pipe the tong is designed to handle. Preferably, however, a ratio of at least 2:1 is obtained between the high speed and the medium speed operation of the tong. For a tong as shown in FIG. 1 capable of handling a maximum 4½" diameter pipe, the high speed motor preferably will rotate the gear 12 and therefore the pipe in the range of 80–120 rpm. The pipe may rotate at medium speed in the range of between 40–50 rpm, and may rotate in the range of between 30–40 rpm at the low speed range. Assuming 2000 psi pressure is applied to the tandem motor as described herein from a 40 gpm gear-type pump, the above described tong may effectively stall under high speed at approximately 1000 pounds, under medium speed at approximately 3000 pounds, and under low speed at approximately 5000 pounds. Thus, it may be seen that in the low speed, the composite motor allows the torque to be substantially increased compared to either the high speed torque or the medium speed torque so that the desired high gripping torque for making up and breaking apart the pipe joint may be easily achieved. It should be understood that the terms high speed, medium speed, low speed, low torque, medium torque, and high torque with respect to the main drive motors are each relative terms. As such, a medium speed/medium torque motor is defined as any motor having a lower speed and a higher torque than a high speed/low torque motor, and a low speed/high torque motor is defined as any motor having a lower speed and a higher torque than a medium speed/medium torque motor.

Numerous modifications from the illustrative embodiments disclosed herein may be made without departing from the spirit or scope of the invention. For example, the tandem drive motor described herein may be pneumatically powered instead of being hydraulically powered. Also, more than two fluid motors could be coupled together to form a multiple section fluid motor with a common drive shaft to achieve more than three possible motor speeds, although additional operator handles would then also be required. Further, the automatic door latch mechanism disclosed herein could be employed on any open throat tong having a hinged door. These and other modifications of the invention will be apparent to those skilled in the art and are intended to be within the scope of the present invention.

What is claimed is:

1. A power tong for making up and breaking apart a pipe joint, comprising:

a ring member rotatable relative to a tong body and having a plurality of interior camming surfaces;

a cage plate at least partially disposed between said ring member and said pipe joint;

a plurality of jaw members carried by said cage plate assembly for gripping engagement with said pipe joint upon rotation of said ring member;

a source of pressurized fluid;

a high speed/low torque motor responsive to said pressurized fluid for rotating said ring member;

a medium speed/medium torque motor responsive to said pressurized fluid for rotating said ring member;

said high speed/low torque motor and said medium speed/medium torque motor being mechanically connecting in tandem with a common drive shaft such that motors rotate said common drive shaft in unison to drive said ring member;

a valve block positionable in a first position for directing substantially all pressurized fluid to said high speed/low torque motor, and positionable in a second position for directing substantially all pressurized fluid to said medium speed/medium torque motor; and said valve block further positionable in a third position for directing pressurized fluid simultaneously through both said motors for rotating said ring member at a lower speed and a higher torque than said medium speed/medium torque motor;

whereby said tong may be operated in any of of a three different speed/torque ranges without shifting gears into and out of driving engagement with said ring member.

2. A power tong as defined in claim 1, further comprising:

said valve block further positionable for powering each of said motors to rotate said ring member in both forward and reverse directions.

3. A power tong as defined in claim 2, further comprising:

said valve block is positionable by controlling two operating handles for rotating said ring member at one of at least three speed ranges and in either forward or reverse directions.

4. A power tong as defined in claim 1, wherein each of said motors is a hydraulic motor.

5. A power tong as defined in claim 1, wherein both said ring member and said cage plate assembly include open throat portions for laterally receiving said pipe joint.

6. A power tong as defined in claim 5, further comprising:

a pivotable tong door;

a door latch mechanism for latching said door to substantially minimize spreading of the open throat tong body and for unlatching said door to open said door;

latch drive means responsive to said pressurized fluid source for activating said door latch mechanism; and control means for automatically controlling pressurized fluid flow to said latch drive means in response to activation of said valve means.

7. A power tong as defined in claim 6, wherein said door latch mechanism comprises:

a door latch shaft rotatably mounted to said tong body and having a non-cylindrical latching surface;

said pivotable door includes a slot portion for receiving said door latch shaft; and rotation of said door latch shaft relative to said slot portion latches said door closed.

8. A power tong as defined in claim 1, wherein said plurality of jaw members comprises a plurality of dies carried by said jaw members for gripping engagement with said pipe joint over a composite angle of at least 230°.

9. A power tong as defined in claim 3, wherein said valve block comprises first and second 4-way, three position valves.

10. In an open throat power tong for making up and breaking apart a pipe joint, including a partial ring member rotatable relative to a tong body, a pressurized fluid source, main drive means for rotating said ring member in response to said pressurized fluid source, valve means for controlling pressurized fluid flow to said drive means, and a pivotable tong door, door latching apparatus comprising:

a door latch mechanism for latching said door to substantially minimize spreading of the open throat tong body and for unlatching said door to open said door;

latch drive means hydraulically in parallel with said main drive means and responsive to said pressurized fluid source for automatically latching said door latch mechanism;

an accumulator for providing pressurized fluid to said latch drive means for causing said latch drive means to automatically unlatch said door latch mechanism when said main drive means is deactivated; and control means for automatically controlling pressurized fluid flow to said drive means in response to activation of said valve means.

11. The apparatus as defined in claim 10, wherein said door latch mechanism comprises:

a door latch shaft rotatably mounted to said tong body and having a non-cylindrical latching surface;

said pivotable door includes a slot portion for receiving said door latch shaft; and rotation of said door latch shaft relative to said slot portion latches said door closed.

12. The apparatus as defined in claim 10, wherein said latch drive means is a hydraulic motor affixed to said tong body adjacent said door latch mechanism.

13. The apparatus as defined in claim 10, further comprising:

a powered hydraulic cylinder for closing said pivotable tong door.

14. The apparatus as defined in claim 11, further comprising:

a stop member for emgagement with said door latch shaft to prevent further rotation of said door latch shaft once said latch drive means has latched said door latch mechanism.

15. In an open throat power tong for making up and breaking apart a pipe joint, including a partial ring member rotatable relative to a tong body, a pressurized fluid source, main drive means for rotating said ring member in response to said pressurized fluid source, valve means for controlling pressurized fluid flow to said drive means, and a pivotable tong door, door latching apparatus comprising:

a door latch mechanism for latching said door to substantially minimize spreading of the open throat tong body and for unlatching said door to open said door;

latch drive means hydraulically in parallel with said main drive means and responsive to said pressurized fluid source for automatically latching said door latch mechanism, said latch drive means including a hydraulic motor affixed to said tong body adjacent said door latch mechanism, a motor drive gear connected to said hydraulic motor, and a door latch drive gear connected to said door latch mechanism for engagement with said motor drive gear for activitating said door latch mechanism; and control means for automatically controlling pressurized fluid flow to said latch drive means in response to activation of said valve means.

16. The apparatus as defined in claim 15, further comprising:

said door latch mechanism including a door latch shaft rotatably mounted to said tong body and having a non-cylindrical latching surface;

said pivotable door includes a slot portion for receiving said door latch shaft; and rotation of said door latch shaft relative to said slot portion latches said door closed.

17. The apparatus as defined in claim 15, further comprising:

an accumulator for providing pressurized fluid to said latch drive means for causing said latch drive means to automatically unlatch said door latch mechanism when said main drive means is deactivated.

18. The apparatus as defined in claim 16, further comprising:

a stop member for engagement with said door latch shaft to prevent further rotation of said door latch shaft once said latch drive means has latched said door latch mechanism.

* * * * *